US008739671B2

(12) United States Patent
Dau et al.

(10) Patent No.: US 8,739,671 B2
(45) Date of Patent: Jun. 3, 2014

(54) METHOD FOR PRODUCING A LARGE-CALIBER EXPLOSIVE PROJECTILE

(71) Applicant: Rheinmetall Waffe Munition GmbH, Unterlüss (DE)

(72) Inventors: Ole Dau, Reppenstedt (DE); Uwe Naderhoff, Fassberg (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 14/068,783

(22) Filed: Oct. 31, 2013

(65) Prior Publication Data

US 2014/0076129 A1 Mar. 20, 2014

Related U.S. Application Data

(62) Division of application No. 13/322,510, filed as application No. PCT/EP2010/002795 on May 6, 2010, now Pat. No. 8,601,950.

(30) Foreign Application Priority Data

May 25, 2009 (DE) ..... 10 2009 022 495

(51) Int. Cl.
*F42B 12/20* (2006.01)
*F42B 33/02* (2006.01)

(52) U.S. Cl.
USPC ..... 86/51; 86/20.12; 86/20.14; 102/473; 102/481

(58) Field of Classification Search
USPC ..... 102/473, 481, 489, 499; 86/51, 53, 86/20.12, 20.14
See application file for complete search history.

(56) References Cited

U.S. PATENT DOCUMENTS 2,373,883 A 4/1945 Ferrel
3,693,548 A 9/1972 Dereich et al.

(Continued)

FOREIGN PATENT DOCUMENTS

DE 1 024 406 4/1954
EP 1 338 860 A2 8/2003
EP 1 363 102 A2 11/2003

OTHER PUBLICATIONS

International Search Report (translation) for PCT/EP2010/002795; Dec. 2010.*

(Continued)

*Primary Examiner* — James Bergin
(74) *Attorney, Agent, or Firm* — Griffin & Szipl, P.C.

(57) ABSTRACT

A method is provided for producing a large-calibre explosive projectile having a projectile casing with an ogival front part, which surrounds an internal area filled with a plastic-bonded explosive charge and, at a nose end, has a mouth closed by a nose fuze, wherein an elastic liner is arranged between the explosive charge and the inner wall of the projectile casing. The projectile casing is produced in two parts, such that, in the direction of the longitudinal axis of the projectile casing, a tail-end projectile casing section and an annular front projectile casing section, which contains the mouth, can be connected to one another in the area of the ogival front part, via a screw connection. The liner is introduced into the tail-end projectile casing section and the explosive charge is introduced into the liner before the two projectile casing sections are connected to one another.

4 Claims, 1 Drawing Sheet

(56) References Cited

U.S. PATENT DOCUMENTS

| | | | | |
|---|---|---|---|---|
| 3,786,714 | A | 1/1974 | Dereich et al. | |
| 4,365,556 | A | 12/1982 | Reibel | |
| 4,615,272 | A | 10/1986 | Aubert | |
| 5,054,399 | A * | 10/1991 | Bilek et al. | 102/481 |
| 5,939,662 | A * | 8/1999 | Bootes et al. | 102/473 |
| 6,860,185 | B2 | 3/2005 | Altenau | |
| 7,114,449 | B2 | 10/2006 | Altenau | |
| 7,370,585 | B2 | 5/2008 | White et al. | |
| 7,992,498 | B2 | 8/2011 | Ruhlman et al. | |
| 8,408,138 | B2 | 4/2013 | Schwenzer et al. | |
| 8,601,950 | B2 * | 12/2013 | Dau et al. | 102/473 |
| 2004/0031380 | A1 | 2/2004 | Altenau | |
| 2006/0011053 | A1 | 1/2006 | Altenau | |

OTHER PUBLICATIONS

Written Opinion of the International Searching Authority (translation) for PCT/EP2010/002795; Dec. 2011.*

International Search Report issued in corresponding application PCT/EP2010/002795, completed Jul. 14, 2010 and mailed Jul. 23, 2010.

http://www.merriam-webster.com/dictionary/ogival, two pages, downloaded Nov. 15, 2011.

http://www.merriam-webster.com/dictionary/ogive?show=0&t=13 . . . , two pages, downloaded Nov. 15, 2011.

* cited by examiner

METHOD FOR PRODUCING A LARGE-CALIBER EXPLOSIVE PROJECTILE

This is a divisional application of application Ser. No. 13/322,510, filed Nov. 25, 2011, which is the National Phase Application in the United States of International Patent Application No. PCT/EP2010/002795 filed May 6, 2010, which claims priority on German Patent Application No. 10 2009 022 495.5, filed May 25, 2009. The entire disclosures of the above patent applications are hereby incorporated by reference.

FIELD OF THE INVENTION

The invention relates to a method for producing a large-caliber explosive projectile having a projectile casing with an ogival front part, which projectile casing surrounds an internal area that is filled with a plastic-bonded explosive charge, and which projectile casing has a mouth hole, which can be closed by a nose fuze, at the tip end. The invention also relates to a large-caliber explosive projectile produced using this method.

BACKGROUND OF THE INVENTION

By way of example, a method in accordance with the field of the invention is known from document EP 1 338 860 B1. In this case, a casing, which is composed, for example, of an elastic plastic (also referred to in the following text as a "liner") is first of all introduced via a mouth hole into the internal area of the projectile casing, and the explosive charge is then cast into the liner. In this case, the liner is required in order to decouple the explosive charge from the inner wall of the projectile casing when temperature fluctuations occur, because of the different volume coefficients of expansion of the explosive charge and of the projectile casing material.

The primary disadvantage of this known method is that the mouth hole, which is designed for a nose fuze to be screwed into, has a small diameter, as a result of which both the introduction into and the positioning of the liner in the internal area of the projectile casing, and the introduction of the explosive charge, which can be cast and is generally highly viscous, into the liner are extraordinarily time-consuming.

The invention is based on the object of specifying a method of the type mentioned initially, in which both the liner and the explosive charge can be introduced into the projectile casing of an explosive projectile in a simple manner, quickly and precisely. A further aim of the invention is to disclose a large-caliber explosive projectile that is produced using this method.

SUMMARY OF THE INVENTION

According to the invention, with respect to the method, this object is achieved by the features of a first embodiment, and with respect to the explosive projectile, it is achieved by the features of fourth embodiment of the invention. Furthermore, particularly advantageous refinements of the invention are disclosed with respect to additional embodiments of the invention.

Thus, in accordance with the first non-limiting embodiment of the invention, a method is provided for producing a large-caliber explosive projectile (1) having a projectile casing (2) provided with an ogival front part (2'), which projectile casing (2) surrounds an internal area (6) that is filled with a plastic-bonded explosive charge (9), and which projectile casing (2) has a mouth hole (5), which can be closed by a nose fuze (4), at the tip end, having the following featured steps: (a) the projectile casing (2) is produced as an at least two-part casing, such that, in the direction of the longitudinal axis (11) of the projectile casing (2), a tail-end projectile casing section (20) and an annular front projectile casing section (21), which contains the mouth hole (5), are produced, in which case the two projectile casing sections (20, 21) can be connected to one another via a screw connection (22) in the area of the ogival front part (2'); (b) before the connection of the two projectile casing sections (20, 21), a casing (8) that is matched to the internal contour of the internal area (6) and is composed of an elastic material is first of all introduced into and positioned in the internal area (6) in the tail-end projectile casing section (20), through its front-end opening (23); (c) the plastic-bonded explosive charge (9) is then introduced into the casing (8) and, after it is cured, the casing (8) is closed by a cover (26), forming a seal; (d) an elastic compensation element (10), which is matched to the internal geometry of the front-end projectile casing section (21), is then positioned on the cover (26), and the two projectile casing sections (20, 21) are screwed to one another. In accordance with a second non-limiting embodiment of the present invention, the first embodiment is modified so that the casing is chosen such that the explosive charge (9) projects axially beyond the front edge (24) of the tail-end projectile casing section (20), and in that, after the explosive charge (9) has cured, the explosive charge (9) ends at the front end with a planar surface (25) as a result of appropriate machining, which planar surface (25) projects into the internal area of the front-end projectile casing section (21) after the connection of the two projectile casing sections (20, 21). In accordance with a third non-limiting embodiment of the present invention, the first embodiment and the second embodiment are further modified so that the casing (8) and the cover (26) are adhesively bonded or sealed to one another and/or to the inner wall of the projectile casing (2).

In accordance with a fourth non-limiting embodiment of the present invention, a large-caliber explosive projectile is provided that has a projectile casing (2) with an ogival front part (2'), which projectile casing (2) surrounds an internal area (6) that is filled with a plastic-bonded explosive charge (9), and the ogival front part (2') of which projectile casing (2) has a mouth hole (5), which can be closed by a nose fuze (4), at the tip end, with a casing (8), which consists of an elastic material that is arranged on the inner walls (7) of the internal area (6) of the projectile casing (2), in which casing (8) the explosive charge (9) is located, which explosive charge (9) is closed at the front end by an elastic compensation element (10), wherein the projectile casing (2) consists of at least two projectile casing sections (20, 21) in the direction of its longitudinal axis (11), with the annular front projectile casing section (21), which contains the mouth hole (5), connected in the area of the ogival front part (2') to the tail-end projectile casing section (20) via a screw connection (22), and in that the explosive charge (9) extends into the front projectile casing section (21), and the casing (8) is closed by a cover (26), on the front of which the compensation element (10) rests in an interlocking manner. In accordance with a fifth non-limiting embodiment of the present invention, the fourth embodiment is modified so that the screw connection (22) between the two projectile casing sections (20, 21) is secured against becoming loose by means of an adhesive. In accordance with a sixth non-limiting embodiment of the present invention, the fourth embodiment and the fifth embodiment are further modified so that the length of the front projectile casing section (21) is approximately equal to ⅓ of the overall length of the projectile casing (2). In accordance with a seventh non-limiting embodiment of the present invention, the fourth embodiment, the fifth embodiment, and the sixth embodiment of the invention are further modified so that that the compensation element (10) is composed of an open-pore foam.

The present invention is based essentially on the idea of not introducing the liner and the explosive charge into the internal area of the projectile casing through the mouth hole that is designed for the nose fuze, but through a substantially larger opening. For this purpose, the projectile casing is produced as an at least two-part casing, such that, in the direction of the longitudinal axis of the projectile casing, a tail-end projectile casing section and an annular front projectile casing section that contains the mouth hole are produced, in which case the two projectile casing sections can be connected to one another via a screw connection in the area of the ogival front part. Before the connection of the two projectile casing sections, a liner that is matched to the internal contour of the internal area and is composed of an elastic material is, first of all, introduced into and positioned in the internal area in the tail-end projectile casing section, through its front-end opening. The plastic-bonded explosive charge is then introduced into the liner and, after it is cured, the liner is closed by a cover, which is composed of plastic, for example. An elastic compensation element, which is matched to the internal geometry of the front-end projectile casing section, is then positioned on the cover, and the two projectile casing sections are screwed to one another.

The splitting of the projectile casing into a front and a tail-end projectile casing section results, before complete assembly, not only in a large defined opening for introduction of the liner and of the explosive charge, but also, in consequence, allows the tail-end projectile casing section to be machined internally without any problems, as a result of which the precise internal contour that is created in this way allows the liner to be manufactured matched to the contour. The liner can be introduced into the internal area of this projectile casing section, and can be positioned accurately therein, without the risk of creasing, very well and without further processing steps as a result of the large opening in the tail-end projectile casing section. The opening in the plastic casing, which is likewise correspondingly large, allows the liner to be filled very well with the explosive charge, thus allowing the liner to be filled without cavities and bubbles.

In one embodiment of the invention, the liner is chosen such that the explosive charge projects beyond the tail-end projectile casing section on the front end and that, after the explosive charge has cured, the explosive charge ends at the front end, with a planar surface, as a result of appropriate machining and projects into the internal area of the front-end projectile casing section after the connection of the two projectile casing sections. The liner is hermetically sealed by the cover and adhesive, or sealing, that is introduced. This effectively prevents the liner from sliding as a result of relative movements between the explosive charge and the inner wall of the tail-end projectile casing section.

It has been found to be advantageous for the length of the front projectile casing section to be approximately equal to ⅓ of the overall length of the projectile casing. Furthermore, the compensation element should preferably consist of an open-pore foam. The screw connection between the two projectile casing sections should preferably be secured against becoming loose by means of an adhesive.

BRIEF DESCRIPTION OF THE DRAWINGS

Further details and advantages of the invention will become evident from the follow exemplary embodiments, which are explained with reference to figures, in which.

DETAILED DESCRIPTION OF THE INVENTION

Figure 1:
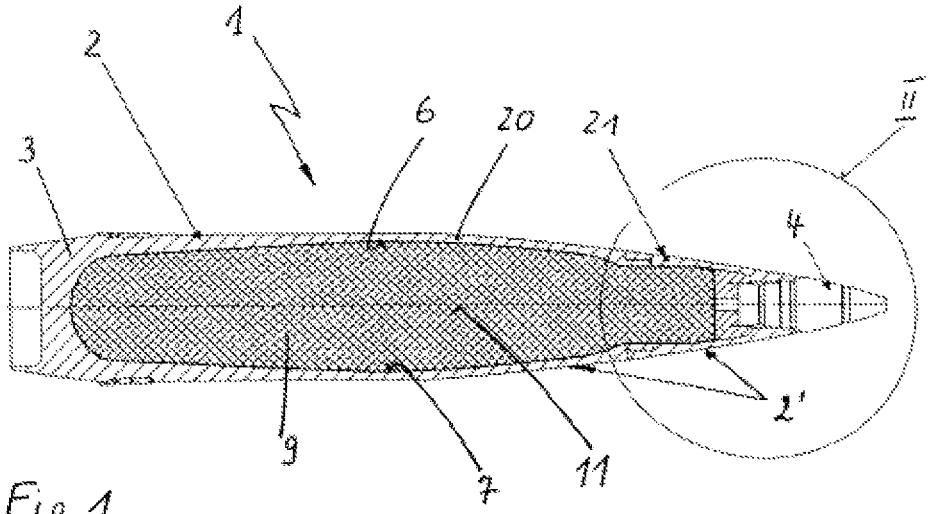
FIG. 1 shows the longitudinal section through an explosive projectile according to the invention.
Figure 2:
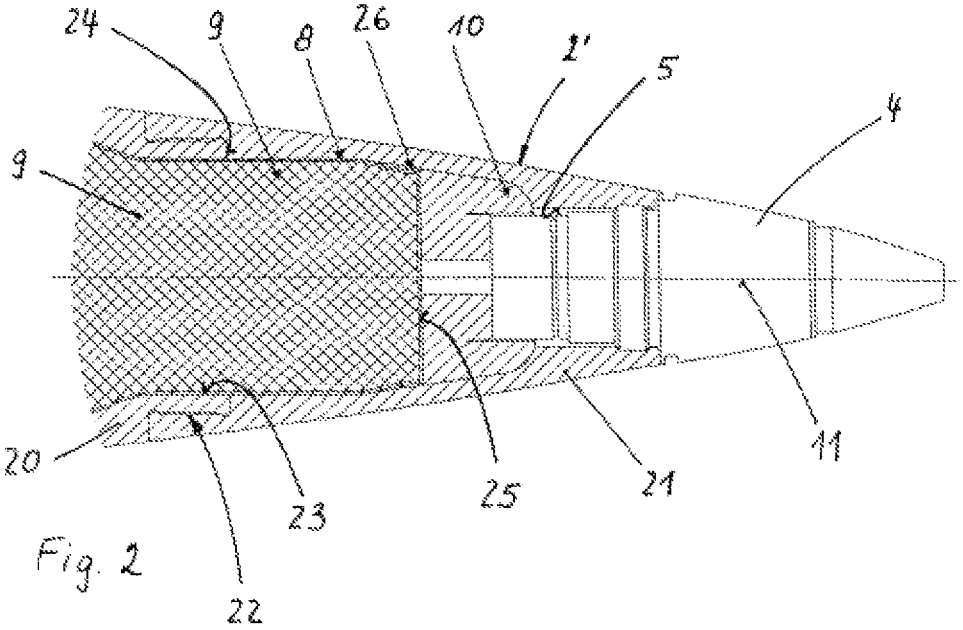
FIG. 2 shows an enlarged view of the area annotated II in FIG. 1.

In FIG. 1, 1 denotes a large-caliber, spin-stabilized explosive projectile, as can be fired from an armored-vehicle howitzer, for example. The explosive projectile 1 comprises a projectile casing 2 with an ogival front part 2', a bottom part 3 and a front-end nose fuze 4. The nose fuze 4 is screwed into a mouth hole 5, which is arranged at the tip end in the projectile casing 2.

The projectile casing 2 surrounds an internal area 6, to whose internal walls 7 an elastic casing (liner) 8, which is composed of plastic, is adhesively bonded. A plastic-bonded, insensitive explosive charge 9 is located in the liner 8. In other words, the explosive charge 9 is contained within the liner 8 as shown in FIG. 1.

At the front end, the explosive charge 9 is closed by an elastic compensation element 10, on whose side facing away from the explosive charge 9 the front area of the internal wall of the projectile casing 2 and the nose fuze 4 exert a predeterminable pressure, thus prestressing the explosive charge 9.

According to the invention, seen in the direction of its longitudinal axis 11, the projectile casing 2 is composed of two projectile casing sections 20, 21, which are connected to one another via a screw connection 22 in the area of the ogival front part 2', and are secured against becoming loose by means of an adhesive. The two housing casing sections 20, 21 are separated in order to introduce the explosive charge 9 into the projectile casing 2. Then, the liner 8 is pushed through the relatively large opening 23 in the tail-end projectile casing section 20 into the internal area 6 of this casing section, and is positioned. In this case, the length of the liner 8 is chosen such that the liner 8 extends at the front end beyond the front edge 24 of the tail-end projectile casing section 20.

The explosive charge 9 is then cast into the liner 8 such that the explosive charge 9 also projects at the front end beyond the tail-end projectile casing section 20. After the explosive charge 9 has cured, this explosive charge is processed, for example, by means of a machining process, such that the explosive charge 9 ends with a planar surface 25 at the front end. The liner 8 is then provided with a cover 26, which is composed of plastic, and is hermetically sealed by means of an adhesive.

The compensation element 10, which is matched exactly to the internal geometry of the front projectile casing section 21, and is composed of an open-pore foam, is positioned on the closed liner 8. This compensation element 10 has a large contact surface with the cover 26 of the liner 8. This allows force to be introduced well, therefore allowing the explosive charge 9 to be positioned accurately in an interlocking and force-fitting manner in its predetermined position in the tail-end projectile casing section 20.

The front projectile casing section 21, which is then screwed onto the tail-end projectile casing section 20, compresses the compensation element 10, which is designed to be oversized, thus pressing the liner 8, filled with the explosive charge 9, into the tail-end projectile casing section 20. This prevents the explosive charge from sliding before final assembly of the explosive projectile 1.

Finally, an explosive nose fuze 4 is screwed and adhesively bonded into the mouth hole 5. In this case, the nose fuze 4 may be designed such that it can be used for further compression of the compensation element 10.

LIST OF REFERENCE SYMBOLS

1 Explosive projectile
2 Projectile casing
2' ogival front part
3 Bottom part
4 Nose fuze
5 Mouth hole
6 Internal area
7 Inner wall
8 Casing, liner
9 Explosive charge
10 Compensation element
11 Longitudinal axis
20 (Tail-end) projectile casing section
21 (Front) projectile casing section
22 Screw connection
23 Opening
24 Front edge
25 Planar surface
26 Cover

The invention claimed is:

1. A method for producing a large-caliber explosive projectile comprising a projectile casing provided with an ogival front part, wherein the projectile casing surrounds an internal area of the explosive projectile that is filled with a plastic-bonded explosive charge, and the projectile casing has a mouth hole at a tip end, wherein a nose fuze is disposed to close the mouth hole, wherein the method comprises the steps of:

(a) producing the projectile casing as an at least two-part casing comprising a tail-end projectile casing section and an annular front projectile casing section that contains a mouth hole, wherein in a direction of a longitudinal axis of the projectile casing, the annular front projectile casing section is disposed in front of the tail-end projectile casing section so that the annular front projectile casing section and the tail-end projectile casing section are connectable to one another via a screw connection in an area of the ogival front part;

(b) before connecting the annular front projectile casing section to the tail-end projectile casing section, matching a liner to an internal contour of the internal area of the explosive projectile, wherein the liner comprises an elastic material, and introducing and positioning the liner into a first portion of the internal area that is in the tail-end projectile casing section, wherein the liner is introduced and positioned into the first portion of the internal area through a front-end opening of the tail-end projectile casing section;

(c) then introducing the plastic-bonded explosive charge into the liner and, after the plastic-bonded explosive charge is cured, closing the liner using a cover, and forming a seal between the liner and the cover;

(d) then positioning an elastic compensation element that is matched to an internal geometry of the annular front projectile casing section on the cover, and connecting the annular front projectile casing section to the tail-end projectile casing section so that the annular front projectile casing section and the tail-end projectile casing section are screwed to one another.

2. The method as claimed in claim 1, wherein the liner is configured so that the explosive charge projects axially beyond a front edge of the tail-end projectile casing section, and wherein, after the explosive charge has cured, the explosive charge ends at a front end with a planar surface as a result of appropriate machining, wherein the planar surface of the explosive charge projects into a second portion of the internal area of the explosive projectile that is in the annular front projectile casing section after connection of the annular front projectile casing section and the tail-end projectile casing section to one another.

3. The method as claimed in claim 2, wherein the liner and the cover are adhesively bonded or sealed to one another, or to an inner wall of the projectile casing, or to both one another and to the inner wall of the projectile casing.

4. The method as claimed in claim 1, wherein the liner and the cover are adhesively bonded or sealed to one another, or to an inner wall of the projectile casing, or to both one another and to the inner wall of the projectile casing.

* * * * *